US005416268A

United States Patent [19]

Ellis

[11] Patent Number: 5,416,268

[45] Date of Patent: May 16, 1995

[54] ELECTRICAL CABLE WITH IMPROVED SHIELD

[75] Inventor: John R. Ellis, Harrisburg, Pa.

[73] Assignee: The Whitaker Corporation, Wilmington, Del.

[21] Appl. No.: 91,577

[22] Filed: Jul. 14, 1993

[51] Int. Cl.[6] ..... H01B 7/34

[52] U.S. Cl. ..... 174/36; 174/102 R; 174/117 F

[58] Field of Search ..... 174/36, 102 R, 106 R, 174/117 F

[56] References Cited

U.S. PATENT DOCUMENTS

| | | | |
|---|---|---|---|
| 3,032,604 | 5/1962 | Timmons | 174/36 |
| 4,041,237 | 8/1977 | Stine et al. | 174/36 |
| 4,098,346 | 6/1978 | Stine et al. | 174/36 |
| 4,323,721 | 4/1982 | Kincaid et al. | 174/36 |
| 4,374,299 | 2/1983 | Kincaid | 174/36 |
| 4,398,058 | 8/1983 | Gerth et al. | 174/106 D |
| 4,510,346 | 4/1985 | Bursh, Jr. et al. | 174/36 |
| 4,800,236 | 1/1989 | Lemke | 174/36 |

*Primary Examiner*—Morris H. Nimmo

[57] ABSTRACT

A transmission cable for transmitting differential logic signals is disclosed having an improved shielding. The cable includes a pair of insulated signal conductors in side by side relation with a layer of electrically conductive material wrapped around the two signal conductors. A non-insulated drain wire is disposed axially along the outside of the wrap of shielding material adjacent one of the signal conductors. The layer of conductive material is continued around the outside of the drain wire thereby forming an additional wrap of the shielding about at least a part of the cable assembly. The drain wire is in electrical engagement with the shielding material.

13 Claims, 3 Drawing Sheets

+V
-V
40
42
44
46
48
50
12
14
18
+
-

ELECTRICAL CABLE WITH IMPROVED SHIELD

The present invention relates to an electrical cable having at least two insulated signal conductors and one drain wire in contact with a layer of shielding that is wrapped around the signal conductors.

BACKGROUND OF THE INVENTION

Modern signal transmission cables typically are shielded by a thin conductive foil and include a drain wire in contact therewith, running the length of the cable, that is used to terminate the foil shield. Such a transmission cable is shown in FIG. 1 at 10. The cable 10 includes a pair of insulated signal conductors 12 and 14 and a non-insulated drain wire 16 all of which are arranged side by side as shown. A layer of conductive shielding material 18 is wrapped around the three conductor assembly so that it is in electrical contact with the non-insulated drain wire. This shielding prevents emissions from the cable as well as provides isolation from nearby or stray signals, and the planar structure of the cable provides advantages in routing and other cable management tasks for certain applications. When this cable is used in differential logic applications with relatively fast rise times and high bit rates, the propagation delay of the signal along the two signal conductors 12 and 14 becomes important. The air gaps 20, as seen in FIG. 1, result in asymmetrical capacitive coupling between the shield and the two signal conductors. The dielectric constant is different for each one because the air gaps affect the signal on the conductor 12 more than the signal on the conductor 14, thereby causing different propagation delays for the two signals. In fast switching circuitry, high speed clocklines, and long-run cable configurations this difference can cause the output signal to either not reach the threshold value or, if it does, the signal pulse may be so narrow that it will lack sufficient energy to register as a data bit thereby causing a parity error. A solution to this problem is to arrange the drain wire in the space 22, against the outer insulation of the two signal conductors. However, this adds a bulge in the otherwise flat surface of the cable thereby adversely affecting installation in many applications. Additionally, such an arrangement makes it difficult to terminate the drain wire by automated equipment.

What is needed is a transmission cable having signal conductors with substantially similar propagation delays while maintaining the desired flat profile afforded by arranging the drain wire on the same center line as the two signal conductors.

SUMMARY OF THE INVENTION

An electrical cable is disclosed having at least two insulated conductors arranged side by side so that their axes define a plane. A layer of shielding and a non-insulated drain wire having its axis disposed substantially parallel with the plane are provided. The layer of shielding extends completely around the two insulated conductors for at least one wrap. The non-insulated drain wire is disposed outside of this first wrap of the shielding layer. An additional at least partial wrap of the layer of shielding is provided over a portion of the first wrap and the drain wire, the drain wire being in electrical engagement with the layer of shielding.

DESCRIPTION OF THE PREFERRED EMBODIMENT

Figure 1:
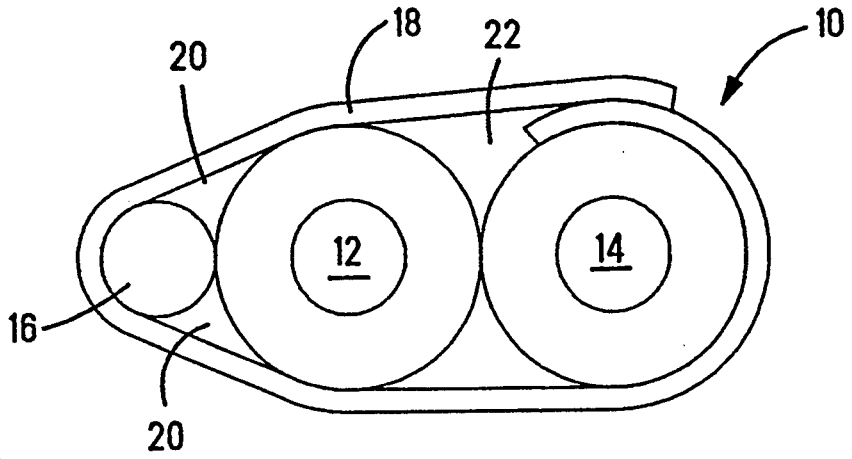
PRIOR ART Fig. 1
FIG. 1 is a external end view of a transmission cable that is known in the industry.
Figure 2:
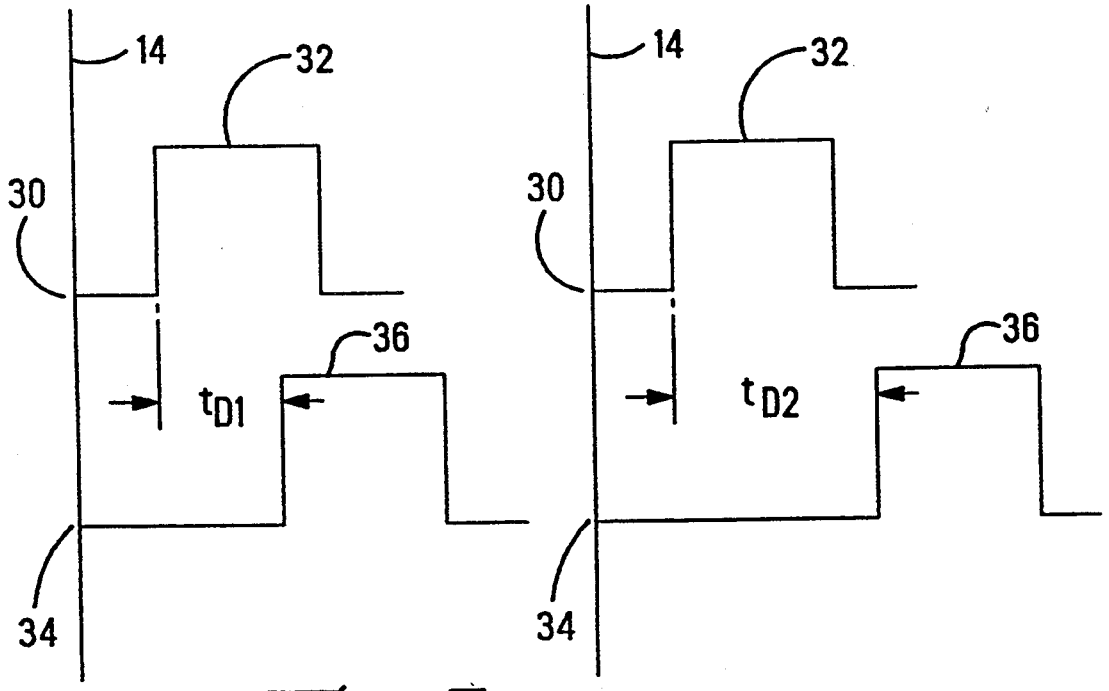
FIG. 2 is a schematic representation of delay skew in the cable of FIG. 1.

There is shown in FIG. 2 a schematic representation of propagation delay for the pair of insulated conductors 12 and 14 of FIG. 1, showing, what is known in the industry as "delay skew". Following is a brief discussion of one of the causes of delay skew as it applies to the present invention.

Figures 3, 4, 5:
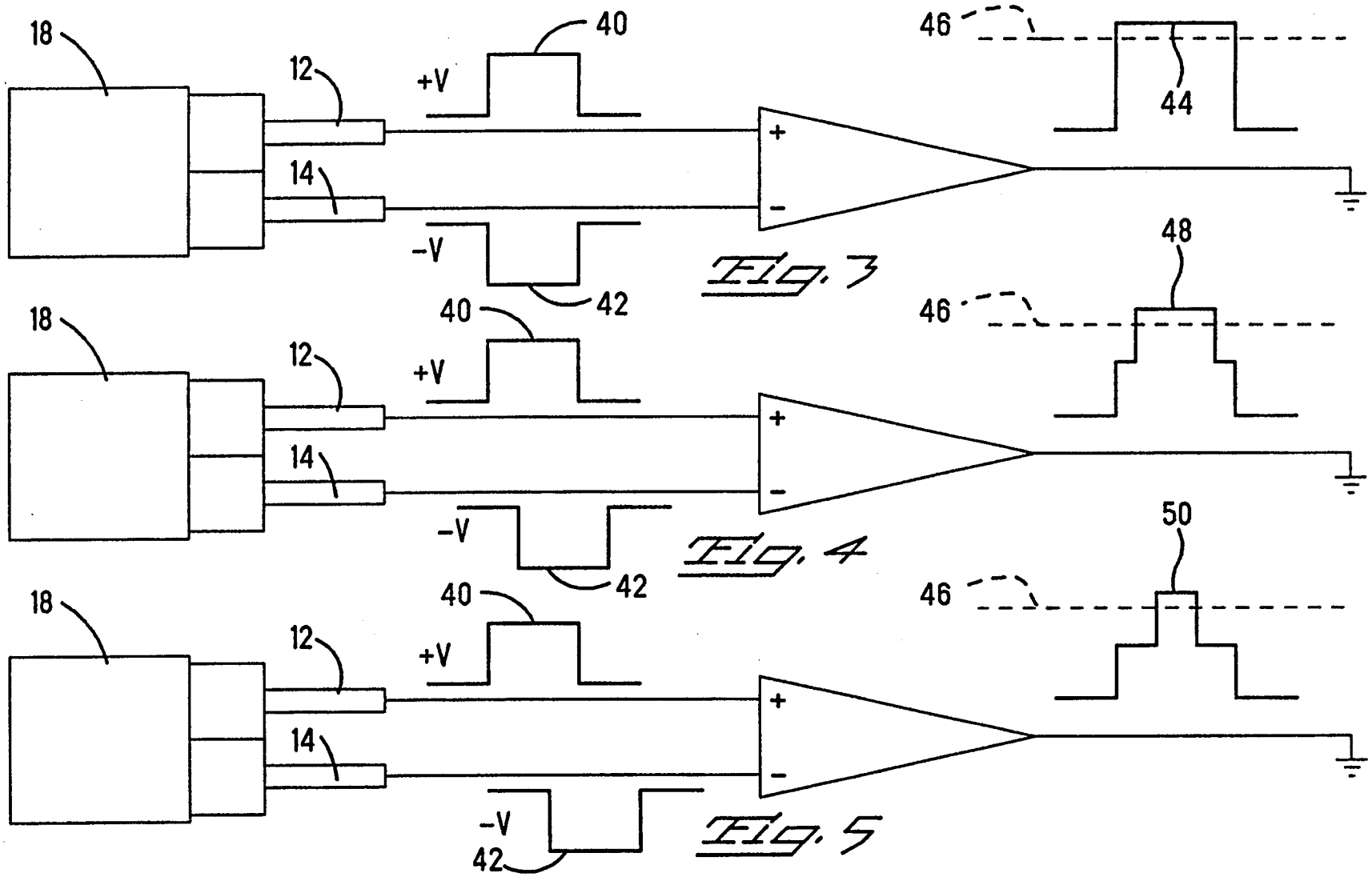
FIGS. 3, 4, and 5 schematically represent the output signals resulting from delay skew.

A signal is impressed on both signal conductors at the input end 30 of the cable and is shown as a single pulse 32 on each. Note that in differential mode these two pulses would be 180 degrees out of phase, however, for added clarity they are shown in phase. When the signal reaches the output end 34 of the cable, the pulses have shifted to the right, as viewed in FIG. 2, an amount equal to the propagation delay for that particular cable type and length. These shifted pulses are identified as 36 and 36. Note that the propagation delay for the conductor 14 is tD2 while the delay for the conductor 12 is a lesser amount tD1 caused by the air gaps 20. The delay skew, as known in the industry, is defined as being equal to the absolute value tD2-tD1. The delay skew is further illustrated in FIGS. 3, 4, and 5. In FIG. 3 the differential signal indicated by the pulse forms 40 and 42 are applied to the input end of the conductors 12 and 14. If the output signal were sampled at that point it would look similar to the pulse 44 that peaks well above the threshold voltage 46 and having a full width time duration. If the output signal were sampled at a point significantly further down the length of the cable, the position of the pulse 40 would be retarded with respect to the position of the pulse 42 resulting in significant delay skew. This would result in an output signal similar to the pulse 48 of FIG. 4. Note that the width of the portion of the pulse 48 that exceeds the threshold voltage is considerably narrower than that of the pulse 44 of FIG. 3. Similarly, if the output signal were sampled much further down the length of the cable, the delay skew would be even greater, resulting in a very narrow pulse width as shown at 50 in FIG. 5. While the pulse 50 does exceed the threshold voltage, it is so narrow that it may have insufficient energy to be accepted as a valid data bit. If the delay skew were even greater, the pulse 50 might not exceed the threshold voltage 46, either case resulting in a parity error. By way of example, a typical delay skew for the cable of FIG. 1 is about 42 picoseconds per foot, resulting in a 4.2 nanosecond delay skew for a cable that is 100 feet long. In high frequency applications, such as 500 megahertz and above, the pulse width is only one nanosecond or less so that a 4.2 nanosecond delay skew is completely unworkable.

Figure 6:
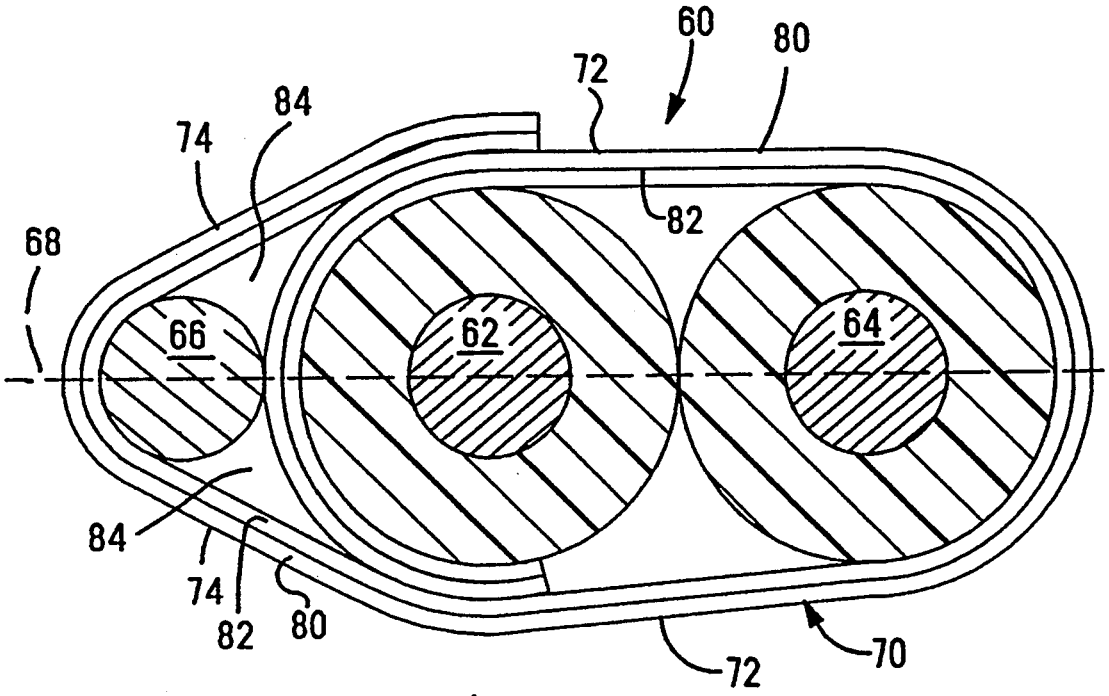
FIG. 6 is an external end view with parts cut away for the purpose of a transmission cable illustrating the teachings of the present invention.

This delay skew can be significantly reduced by shielding the insulated conductor 12 from the effects of the air gaps 20 by placing the shield between the conductor and the air gaps. Such a structure is shown in FIG. 6. There, a cable 60 is shown having first and second insulated signal conductors 62 and 64 respectively and a drain wire 66, arranged so that their axes fall on a common plane 68. A layer 70 of shielding is wrapped completely around the two insulated conductors 62 and 64 for at least one full wrap 72, then an additional amount is wrapped about the drain wire 66 as at least a partial wrap 74 and terminated against the full wrap 72 so that the drain wire is sandwiched between the wrap 72 and the wrap 74. The layer 70 of shielding is a composite of two layers, a layer 80 of non-conductive material such as polyester or some other suitable carrier material and a layer 82 of aluminum or other suitable electrically conductive material deposited on the carrier, or otherwise attached thereto. With this arrangement the air gaps 84, adjacent the drain wire 66, are isolated from the insulated signal conductor 62 and, therefore, do not significantly contribute to propagation delay in that conductor. By way of example, a typical delay skew for the cable of FIG. 6 is about 5 picoseconds per foot, resulting in a 0.5 nanosecond delay skew for a cable that is 100 feet long. This is well within the acceptable working range for a 500 megahertz application. The wrap 72 may be multiple wraps around the two insulated conductors and the partial wrap 74 may be a full wrap around the entire assembly or it may be multiple wraps therearound. The only requirement is that the drain wire 66 be disposed between any two adjacent wraps and in electrical engagement with the layer 82 of one of them. In the present example, the non-insulated drain wire 66 is in electrical engagement with the conductive layer 82 of the wrap 74.

Figure 7:
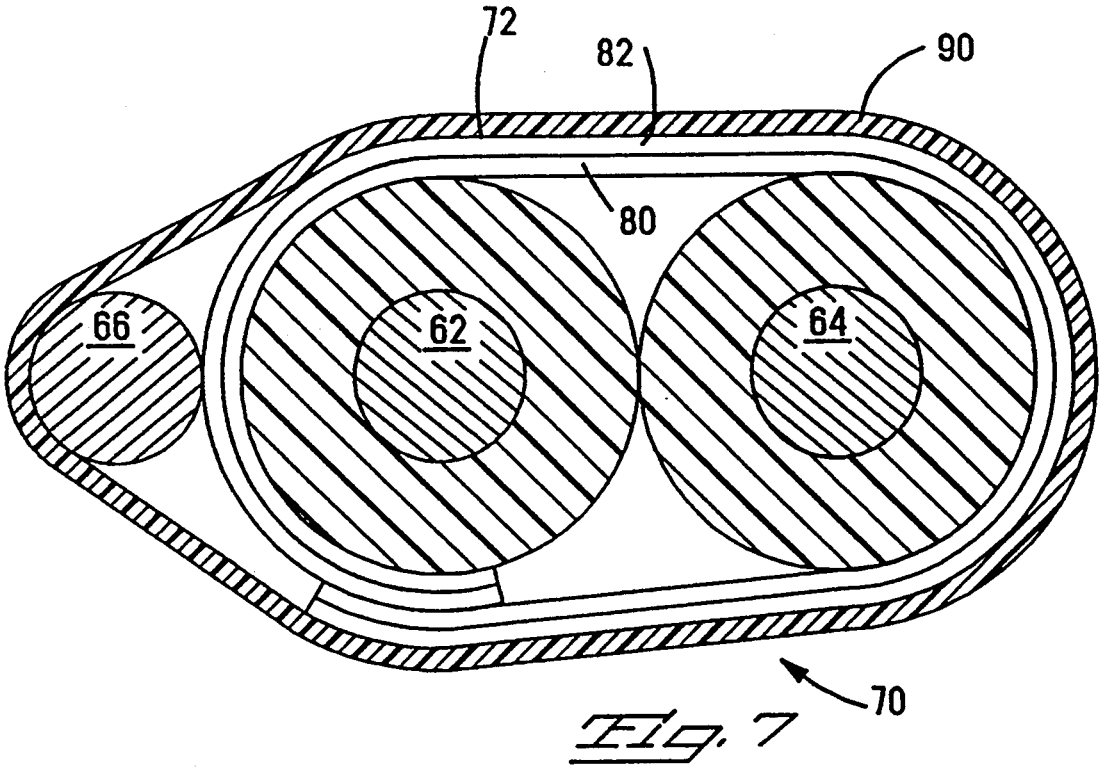
FIG. 7 is a view similar to FIG. 6, with parts cut away for the purpose of illustration.

While, in the present example, the drain wire 66 is shown with its axis on the plane 68, it need not be so, provided that a flat cable profile is not desired nor needed. Additionally, the conductive layer 82 and the non-conductive layer 80 may be reversed so that the conductive layer is facing outwardly from the wrap 72 so that the drain wire 66 is in electrical engagement therewith instead of with the conductive layer of the wrap 74. An alternative embodiment, as shown in FIG. 7, utilizes this reversed layer 70 which is wrapped only around the two insulated signal conductors 62 and 64. The non-insulated drain wire 66 is held in electrical engagement with the conductive layer 82 by means of an outer jacket 90.

An important advantage of the present invention is that, in a differential pair cable, significant signal skew is reduced to a negligible amount or completely eliminated while maintaining the drain wire in the same plane as the two signal conductors for ease of cable management. Additionally, by placing the drain wire in the same plane with the signal conductors, it is easier to find and terminate by automated equipment.

I claim:

1. An electrical cable having at least two insulated conductors arranged side by side so that their axes define a plane, only one layer of shielding, and a non-insulated drain wire having its axis disposed substantially parallel with said plane, wherein said layer of shielding extends completely around said two insulated conductors for at least one wrap, but not therebetween, and at least an additional partial wrap of said layer of shielding over a portion of said at least one wrap, wherein said non-insulated drain wire is between said one and said partial wraps.

2. The cable according to claim 1 wherein said layer of shielding is a continuous layer.

3. The cable according to claim 2 wherein said layer of shielding includes a layer of electrically non-conductive material and a layer of electrically conducting material arranged back to back as a single composite layer.

4. The cable according to claim 1 wherein the axis of said drain wire is substantially in said plane.

5. An electrical cable having at least two insulated conductors arranged side by side so that their axes define a plane, a layer of shielding, and a non-insulated drain wire having its axis disposed substantially parallel with said plane, wherein said layer of shielding extends completely around said two insulated conductors for at least one wrap, and said non-insulated drain wire is disposed outside said at least one wrap of said layer of shielding, including an additional at least partial wrap of said layer of shielding over a portion of said at least one wrap and said drain wire, said drain wire in electrical engagement with said layer of shielding.

6. The cable according to claim 5 wherein said drain wire is in electrical engagement with said at least partial wrap of said layer of shielding.

7. The cable according to claim 5 wherein said layer of shielding includes a layer of electrically non-conductive material and a layer of electrically conducting material arranged back to back as a single composite layer and said layer of conductive material is facing inwardly toward said drain wire.

8. The cable according to claim 5 wherein said layer of shielding extends around said two insulated conductors but not therebetween.

9. An electrical cable comprising: at least two insulated conductors side by side, a layer of conductive shielding defining at least a first wrap completely around the insulated conductors, and said layer of shielding defining at least one additional wrap with one said additional wrap extending at least partially over another said wrap, and a conductive drain wire disposed between any two of said wraps and in electrical engagement with at least one of said wraps.

10. An electrical cable as recited in claim 9 wherein, the layer of shielding comprises layered conductive material and insulating material, with the conductive material facing and engaging the insulated conductors.

11. An electrical cable as recited in claim 9 wherein, each wrap comprises layered conductive material and insulating material, with the conductive material facing and engaging the insulated conductors, and with the conductive material facing and engaging the drain wire.

12. An electrical cable as recited in claim 9 wherein, each wrap comprises layered conductive material and insulating material, with the insulating material facing and engaging the insulated conductors.

13. An electrical cable as recited in claim 9 wherein, each wrap comprises layered conductive material and insulating material, with the insulating material facing and engaging the insulated conductors, and with the conductive material facing and engaging the drain wire.

* * * * *